United States Patent [19]

Wojdyla

[11] 4,030,590

[45] June 21, 1977

[54] SPACING AND CONNECTING A PLURALITY OF PRINT HEADS

[75] Inventor: Gary A. Wojdyla, Ithaca, N.Y.

[73] Assignee: NCR Corporation, Dayton, Ohio

[22] Filed: Oct. 3, 1975

[21] Appl. No.: 619,289

[52] U.S. Cl. ..... 197/1 R; 197/5; 197/60; 197/82

[51] Int. Cl.[2] ..... B41J 3/04

[58] Field of Search ..... 197/1 R, 5, 60, 65, 197/48, 49, 55, 82, 64

[56] References Cited

UNITED STATES PATENTS

| | | | |
|---|---|---|---|
| 3,670,861 | 6/1972 | Zenner et al. | 197/64 |
| 3,789,969 | 2/1974 | Howard et al. | 197/1 R |
| 3,802,544 | 4/1974 | Howard et al. | 197/1 R |
| 3,825,681 | 7/1974 | Cederberg et al. | 197/1 R X |
| 3,858,703 | 1/1975 | Duley | 197/1 R |
| 3,910,395 | 10/1975 | Colglazier et al. | 197/1 R |

*Primary Examiner*—Ralph T. Radar
*Attorney, Agent, or Firm*—J. T. Cavender; Wilbert Hawk, Jr.; George J. Muckenthaler

[57] ABSTRACT

A tie bar is secured to the drive block of each of two or more print heads for connecting the heads and for spacing thereof at a desired distance. The tie bar serves as a portion of the drive means for moving the print heads, which are slidably supported on a shaft, in side-to-side travel.

2 Claims, 5 Drawing Figures

FIG. 3
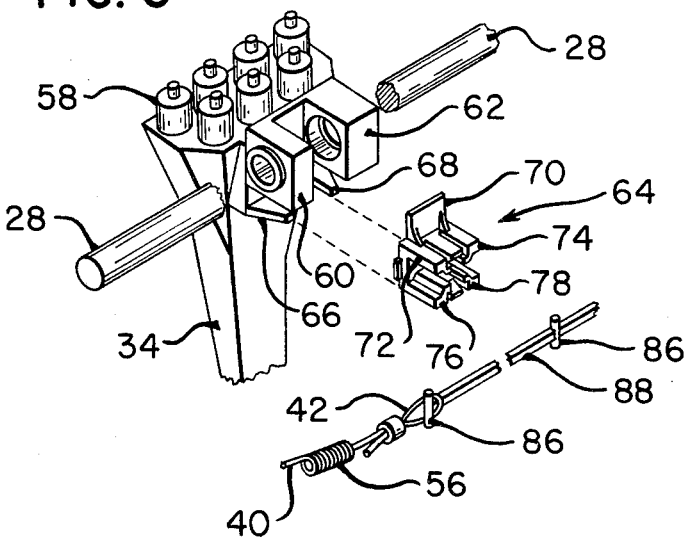
FIG. 5
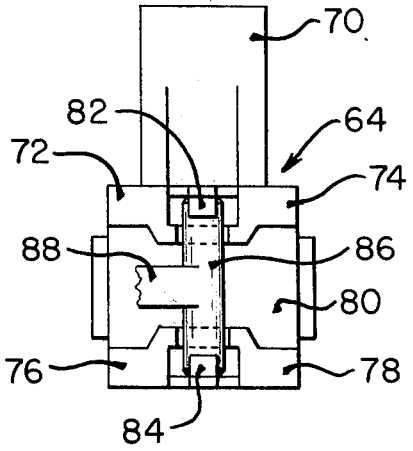
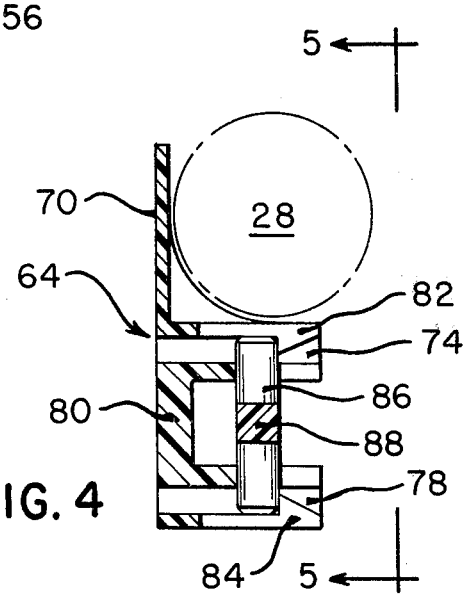
FIG. 4
FIG. 2
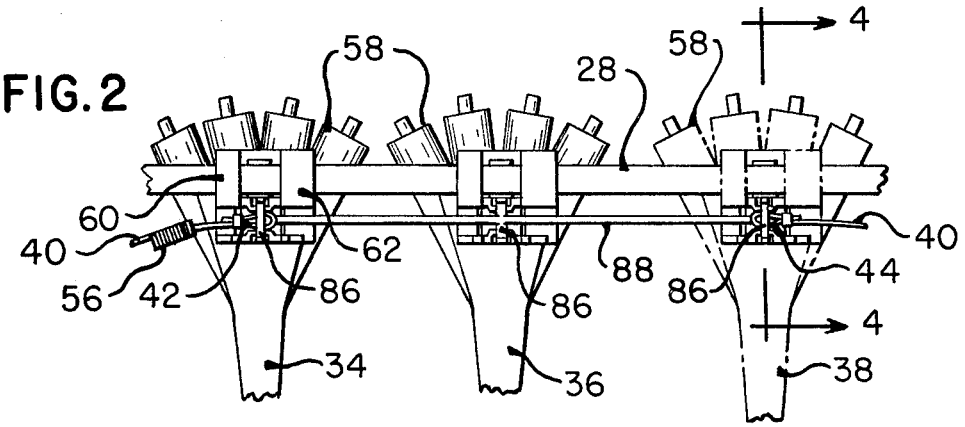

SPACING AND CONNECTING A PLURALITY OF PRINT HEADS

Background of the Invention

In the printing field, it has been common practice over the years to provide more than one printing device in a printer for the purpose of accommodating a plurality of printing functions. For example, it is desirable to provide the customer with a printed receipt of the transaction while at the same time maintaining a separate printed record (journal or audit) of the transaction for the business operation. Additionally, a printer is utilized to accommodate a slip of form wherein validation or the like may be entered on the slip or form which, in turn, may be returned to the customer in the case of a passbook or be retained by the business operation, as in the case of a check or like document.

A printing register of one type, more recently termed a data terminal, includes a plurality of printing stations for printing a receipt, a journal or audit trail, and a slip, form, order or the like and wherein the terminal includes two or more print heads which are caused to be moved across the machine for the printing operations. The main advantage of providing a plurality of print heads is to reduce the time of operation by reducing the distance of travel over that of a single printing device.

Representative of a data terminal with dual three-station printing is Cederberg et al. U.S. Pat. No. 3,825,681 which discloses a carriage mounted on a pair of bars and movable laterally with respect to a frame and provided with a pair of matrix printers capable of printing on two of the three stations at the same time. Transverse movement of the carriage on the bars is accomplished by suitable drive mechanism including a belt attached to the carriage and pulley means motivated by a reversible motor. Duley U.S. Pat. No. 3,858,703 shows a bidirectional dual head printer wherein first and second print head assemblies are mounted on respective carriages which, in turn, are mechanically joined by a coupler. The carriages are secured to a closed loop timing belt driven by a motor.

Summary of the Invention

The present invention relates to printers and more particularly to a plurality of print heads which are spaced a precise distance apart and which are caused to be moved laterally across the machine during printing operations. A pair of spaced parallel guide members or shafts support the print heads during their movement across the machine, each of the print heads being carried in a generally upright position and further carrying inking means in the form of a ribbon cassette. The record media is made to travel in a path between the ribbon and a flat platen whereagainst impact is made by the matrix wires of the print head.

The matrix print heads are spaced a predetermined and precise distance apart by means of a tie or connecting member which is attached to each print head to enable the two or more heads to travel in unison across the machine. Each of the print heads includes a pair of laterally spaced bearings of bifurcated construction for the upper guide shaft and between the bearings is a drive block which is held in place by the guide shaft. The tie or connecting member is attached by an integral pin therewith to each drive block, the tie member, in the case of two print heads, assuming the shape of bottom connected T-bars, and in the case of three print heads, assuming the shape of bottom connected T-bars with a cross bar substantially midway between the T-bars and integral therewith.

Drive means for the print heads is obtained from a motor and comprises a cord or rope driven thereby, the cord being wound on a helical-type shaft on the motor and one end of the cord being attached to the tie member at one end thereof to one T-bar, and the other end of the cord being attached to the tie member at the other end thereof to another T-bar. The print head tie or connecting member serves to space the print heads at the desired distance and also serves as a portion of the drive means for moving the heads laterally in a side-to-side manner across the machine.

In view of the above discussion, the principal object of the present invention is to provide means for connecting a plurality of print heads.

Another object of the present invention is to provide means for spacing a plurality of print heads at a predetermined distance.

An additional object of the present invention is to provide a single member for connecting a plurality of print heads and for spacing same at a precise distance apart.

A further object of the present invention is to provide multiple print head connecting and spacing means utilized as a portion of the drive means for lateral movement of the print heads.

Additional advantages and features of the present invention will become apparent and fully understood from a reading of the following specification taken together with the annexed drawing, in which:

FIG. 2 is a rear elevational view of a plurality of print heads showing the connecting and spacing member as a portion of the print head drive means;

FIG. 3 is a perspective view of a print head with its drive block and a portion of the connecting bar shown in exploded manner;

FIG. 4 is an enlarged view of the drive block taken on the plane 4—4 of FIG. 2; and FIG. 5 is a view of the drive block taken on the plane 5—5 of FIG. 4.

Figure 1:
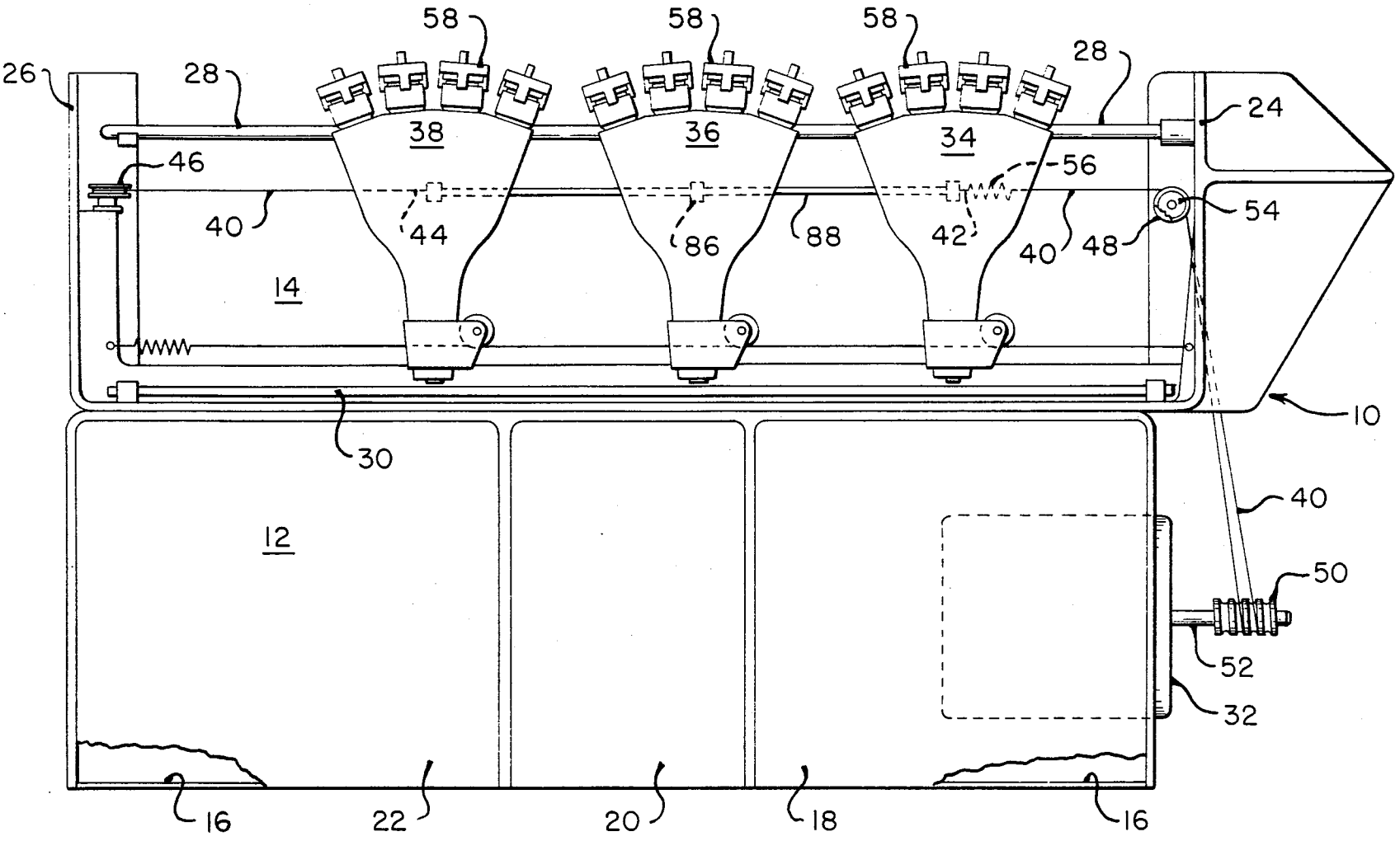
FIG. 1 is a front elevational view of a printer incorporating the subject matter of the present invention.

Referring now to the drawings, FIG. 1 shows, in limited structured illustration, a business machine designated generally as 10 and having lower and upper portions, 12 and 14 respectively, the lower portion 12 including a supporting base 16 and upstanding machine framework compartments 18, 20, and 22 for containing various machine elements not a part of the present invention. The upper portion 14 of the machine 10 includes side walls 24 and 26 connected by suitable rods or rail members, there being a pair of rods 28 and 30, for a purpose to be later described, along with additional connecting frame members for carrying the printing mechanism. A continuous run motor 32 is located at the right, lower, rear area of portion 12 and such motor supplies energy to the various operating members of the machine, one of which is a printing mechanism which is made to travel in a side-to-side direction for effecting the printing operation.

Although the printing mechanism may be one of several types, the present invention is directed to a design which includes matrix type printers, of which there are three of such printers 34, 36 and 38 shown in FIG. 1, to fit in a generally upright manner and carried back and forth across the machine. Forward of the printers 34, 36 and 38, and connected thereto to be carried by each of said printers may be a ribbon cassette (not shown), the structure of which is fully disclosed in a co-pending application covering the invention of Hillis L. Wilson, Ser. No. 523, 179, filed Nov. 12, 1974, and assigned to the same assignee as the present invention.

The printers 34, 36, and 38 are moved in such back-and-forth motion by means of a cord or cable 40, the left-hand end 44 of which is connected to an attaching point on the rear of the left-hand printer 38 (FIGS. 1 and 2), with the cord 40 then extending leftwardly toward and around a pulley 46 journaled at the left side frame 26, and returning in a path rightward and rearward of the printers 34, 36, and 38, toward and around a pulley 48, thence downwardly toward and around a helical-type gear 50 on the shaft 52 of the motor 32, and thence upward and around a pulley 54 and leftward with the right-hand end 42 thereof being connected to an attaching point on the rear of the right-hand printer 34. As illustrated, a spring 56 is provided in the run of the cable 40 to provide and maintain proper tension thereof. Other cord-like members, such as bands, tapes, ropes, etc. may of course be used in place of such cable 40. By appropriate control mechanism, the motor 32 drives, by means of the cord 40 and the various pulleys, the printers 34, 36, and 38 in the desired side-to-side motion for the printing operations.

Suffice it to say that such printing operations may include the printing of a receipt by printer 34 at the right-hand side of the machine, aptly termed a receipt station, the printing of a journal or audit by printer 36 in the central portion of the machine, aptly termed a journal station, and the printing on a form or slip by printer 38 at the left-hand side of the machine, and aptly termed a slip or form station. While there are recited the three printing stations and the three printers, as shown, the invention also is applicable to any machine utilizing two or more printers, the use of two printers also enabling the printing of the three functions, as mentioned, under proper control of the printer and drive mechanism. Each of the printers includes a plurality of solenoids 58 which are positioned to drive the matrix print wires (not shown) in the printing of characters at the several print stations.

The printers or print heads 34, 36, and 38 each include a bifurcated bearing integral therewith and consisting of bearing members 60 and 62 extending rearwardly of the print head for sliding along the support shaft 28 in the side-to-side direction. The lower part of each print head may include a U-shaped portion (not shown) for sliding along the shaft 30 for guiding and maintaining the print head in a precise path in its side-to-side travel.

A drive block 64 (FIGS. 3, 4, and 5) is nested between and downwardly from the bearing members 60 and 62, such bifurcated bearing including ears 66 and 68 spaced to provide a path for the drive block 64 for sliding movement thereof during the assembly or disassembly of the drive block and the print head. The drive block 64 includes a first portion 70 and a second portion 80 connecting a pair of upper fingers 72 and 74 and a pair of lower fingers 76 and 78, which fingers 72 and 74 provide space therebetween for a retaining clip 82 and fingers 76 and 78 provide space therebeteween for a retaining clip 84, such clips 82 and 84 operating to engage and retain a cross member 86 of an elongated bar 88 which bar connects and spaces the print heads 34, 36, and 38. As seen in FIG. 2, the bar 88 connects the three print heads 34, 36, and 38 and includes a cross member 86 at the right-hand end of the bar 88, a cross member 86 at the center thereof and a cross member 86 at the left-hand end of the bar 88, each of such cross members being inserted between the respective fingers 72 and 74, and 76 and 78 of the drive block 64 and retained thereat by the clips 82 and 84, as shown in FIGS. 4 and 5.

While FIG. 2 shows the bar 88 connecting three print heads, a bar may also connect two print heads, such bar having cross members at each end thereof for assembly with the respective drive block of the print head and for providing a grip or connection for the ends of the cord 40. As seen in FIGS. 2 and 3, the ends of the cord 40 are looped around the cross member 86 at each end of the bar 88, such bar providing for connecting and spacing the several print heads at a precise distance from each other and being a portion of the drive means for the printers.

It is thus seen that herein shown and described is an assembly for connecting a plurality of print heads and for spacing said heads at a precise distance from each other, such assembly also being utilized as a portion of the driving means for moving the print heads in their side-to-side travel across a machine. While only one embodiment of the invention has been disclosed herein, certain variations thereof may occur to those skilled in the art. It is contemplated that all such variations, not departing from the spirit and scope of the invention herein, are to be construed in accordance with the following claims.

What is claimed is:

1. In a printer having a plurality of print heads, each print head having a bearing member secured thereto, a
   drive member releasably connected to the bearing member of each of said print heads,
   shaft means journaling said bearing members and supporting said print heads for travel therealong,
   means for driving said print heads along said shaft means, and an elongated bar member releasably connecting the drive member of each of said print heads for spacing said heads a predetermined distance and connected at the ends of said bar member with said driving means for providing the driving means between said print heads.

2. Means for connecting and for spacing a plurality of print heads having means for driving said heads, comprising a
   bearing member secured to each of said print heads,
   shaft means journaling said bearing members for travel therealong, a
   drive member releasably connected to the bearing member of each of said print heads, and an
   elongated bar element releasably connecting each drive member and connected at the ends thereof with said print head driving means for providing the driving means between said print heads.

* * * * *